US006085866A

United States Patent [19]

Kowalewski

[11] Patent Number: 6,085,866

[45] Date of Patent: Jul. 11, 2000

[54] SAFETY DEVICE FOR ASCENDING AND LOWERING PROCESSES BY MEANS OF A ROPE

[76] Inventor: Hubert Kowalewski, Wehe 141, D-32369 Rahden, Germany

[21] Appl. No.: 09/071,408

[22] Filed: May 1, 1998

[30] Foreign Application Priority Data

Oct. 20, 1997 [DE] Germany ..... 197 46 294

[51] Int. Cl.[7] ..... A47L 3/04

[52] U.S. Cl. ..... 182/5; 182/192; 182/193; 188/65.4

[58] Field of Search ..... 182/3, 4, 5, 6, 182/191, 192, 193; 188/65.2, 65.3, 65.4

[56] References Cited

U.S. PATENT DOCUMENTS

| | | | |
|---|---|---|---|
| 288,117 | 11/1883 | Reidy | 188/65.5 |
| 290,007 | 12/1883 | Downing | 182/191 |
| 594,318 | 11/1897 | Beebe | 188/65.4 |
| 641,809 | 1/1900 | Tillottson | 188/65.5 |
| 951,823 | 3/1910 | Luckett | 188/65.5 |
| 2,773,566 | 12/1956 | Staggers . | |
| 4,476,956 | 10/1984 | Eger | 182/5 |
| 4,787,474 | 11/1988 | Brennan . | |
| 5,131,491 | 7/1992 | Varner et al. | 188/65.2 X |

*Primary Examiner*—Daniel P. Stodola
*Assistant Examiner*—Richard M. Smith
*Attorney, Agent, or Firm*—McGlew and Tuttle, P.C.

[57] ABSTRACT

A safety device interacts with a holding rope passing over a deflection point. A housing has a holding rope connection for connecting the housing to one part of the holding rope. A clamping jaw is pivotally connected to the housing. The clamping jaw and housing form a clamp for clamping another part of the holding rope in a clamp position of the clamping jaw and for releasing the another part of the holding rope when the clamping jaw is in a release position. The deflection point is positioned between the one part and the another part of the holding rope. A secure rope is connected to the clamping jaw and extends radially around the clamping jaw and the housing. The secure rope moves the clamping jaw from the release position to the clamping position when a load is placed on the secure rope.

14 Claims, 4 Drawing Sheets

SAFETY DEVICE FOR ASCENDING AND LOWERING PROCESSES BY MEANS OF A ROPE

FIELD OF THE INVENTION

The present invention pertains to a safety device for ascending and lowering for a person by means of a rope according to the double-rope technique, in which the person in question is secured during climbing by a holding rope, which is connected to the person, runs over a higher deflection point, with a clamped position and a released position for the holding rope.

BACKGROUND OF THE INVENTION

Safety devices of the above-described type of this class are used, e.g., where tree care work, such as the securing of the crown or pruning and other work must be performed directly in the trees. Another intended use is in all work at elevated locations, e.g., on facades or roofs or in mountain-climbing technique for securing one's own person and other persons. It is necessary in the above-described operations to protect the climbing person from falling by a corresponding safety device at the moment at which he loses his grip within a tree crown or on a mountain face. For example, catching devices, which run together with the person, are pushed over a holding rope, and from which a separate fastening is established to the climber, have been known for this purpose. As soon as the climber loses his grip and the connection between the climber and the catching device is tensioned as a result, the holding rope running through the catching device is clamped, so that the climber is prevented from falling. Such catching devices have proved, in principle, to be successful, but no dynamic upward and downward movements are possible under load, especially with the double rope.

Moreover, lowering devices with automatic stop function have been known from the state of the art. The securing rope now runs through the device and is automatically clamped. A pressure on a release level present at the lowering device causes the lowering device to release the securing rope running through, so that the climber can displace the lowering device on the securing rope. This securing means has the drawback that the second hand of the climber must secure the rope end running through, while the first hand actuates the release lever. In addition, the ascending of the climber by means of the rope is not possible when such devices are used on the double rope.

Furthermore, so-called height-securing devices have been known in the state of the art, which are arranged between a suspension point and the climber. The height-securing device blocks automatically in the case of an abrupt load of the securing rope, which occurs in the case of a fall. In addition, such a device may be equipped with an automatic rope return function via a spring mechanism. Such devices are used exclusively for securing against falling; they have the drawback that adjustable lowering is not possible under load on the rope. Therefore, they are unsuitable especially for working in tree crowns or the like.

Besides the lowering and catching devices described in the introduction, there also are lowering and rescue devices that are arranged at fixed attachment points. Such devices make possible the uniform, automatic lowering of persons with a corresponding stop function. In addition, they may be provided with hand cranks, which make it possible to pull up persons in rescue situations. Such devices are relatively heavy due to their design and therefore they cannot be carried directly by the climber. Moreover, dynamic ascending by means of the rope is not possible with these devices, because they cannot be used according to the double rope technique due to their suspension.

It is common to all the above-described devices that they are designed for special fields of application and they lack the possibility of performing dynamic ascending processes by means of the rope. In addition, the safety function of such devices does not usually include a fall-dampening function; on the contrary, the safety function begins immediately upon load.

SUMMARY AND OBJECTS OF THE INVENTION

The primary object of the present invention is therefore to provide a safety device for use according to the double rope technique, which has an ergonomically favorable design, meets the highest safety requirements, permits one-hand operation for both ascending and lowering processes, and in which a fall-dampening function is also embodied.

This object of the present invention is accomplished according to the present invention by the safety device having a housing and at least one clamping jaw that can be tensioned against the housing, wherein the end of the holding rope connected to the person is firmly connected to the housing and the free end of the rope is arranged in a clamping mount between the housing and the clamping jaw after running through the deflection point, and a securing rope, which is fixed at the clamping jaw and is led around both parts in a support extending radially outside around the housing and the clamping jaw and by the safety device running over from the released position for the holding rope into the clamped position under tensile load.

It is now possible due to this design according to the present invention to perform both lowering and ascending processes with one hand only. The securing rope is fastened, together with one end of the holding rope, e.g., to the waist belt of the climbing person. As long as the securing rope is not subjected to pull, the safely device is in its released position. This means that the free end of the holding rope, which is not connected firmly to the housing of the safety device, can slide up and down through the safety device unhindered. Since the safety device is located, from an ergonomic viewpoint, basically within the reach of the climbing person, he can displace the safety device with one end at the free end of the holding rope without a problem, especially during ascending by means of the rope. As soon as the safety rope is subjected to pull, e.g., due to the climber slipping off, it tensions the housing and the clamping jaw against each other due to the special circular guide around the safety device. The free end of the holding rope running through the safety device is clamped and blocked due to the clamping. The entire safety device is rotated at the same time around its central axis by the securing rope in the direction of the pulling stress due to the securing rope. Due to this bending, an additional breaking moment is applied to the holding rope. The interaction between the bending and the clamping of the holding rope within the safety device leads to secure holding of the climbing person at the moments of danger. The climber can eliminate the blocking of the holding rope with one hand without problems by relieving the pull of the securing rope. An especially compact safety device, which also meets the highest ergonomic requirements, is obtained due to the design according to the present invention. The facilitated handling of the novel device arises from the fact that a fine and non-jerky adjustment of the braking action of the safety device according to the present invention can be performed by the climbing person due to the regulation of the pull on the securing rope, which can be performed with one hand. The device can thus be used as a general-purpose multi-function device according to the double-rope technique under all working conditions.

Special embodiments of the subject of the present invention appear from the features of the subclaims.

It proved to be especially advantageous for the safety device to have an adjusting means for limiting the maximum clamping force for the holding rope running through between the housing and the clamping jaw. In particular, a catching shock absorption can thus be achieved during a fall in a loosely hanging slope, because the maximum clamping force with which the holding rope running through between the housing and the clamping jaw can be clamped can be limited by this adjusting means. The maximum clamping force of the device according to the present invention is about 300 kg, and it should be borne in mind that values below 700 kg are considered to be "soft" catching shock values.

An especially simple design embodiment of the adjusting means is achieved by the adjusting means having a spacing screw, which is arranged adjustably in a threaded hole of the housing of the safety device and with which the minimum distance between the housing and the clamping jaw can be set.

Furthermore, it proved to be advantageous for the clamping mount for the holding rope running through between the housing and the clamping jaw being an essentially cylindrical through hole, which is recessed half in the housing and half in the movable clamping jaw. This design guarantees a reproducible clamping action, on the one hand, and a precise guiding of the holding rope within the safety device under all operating conditions, on the other hand.

If there is a holding edge on the upper side of the through hole facing the deflection point of the holding rope, this holding edge additionally guarantees that when the safety device bends as a consequence of a pull on the securing rope, the holding rope is subject to an additional, reliable braking action. This braking action can be set by the design within certain limits depending on the size of the radius of the holding edge.

According to a special embodiment of the subject of the present invention, a groove friction means in the form of a receiving groove extending essentially at right angles to the central axis of the through hole may be located on the circumferential surface of the housing at the holding edge in the upper area of the end of the through hole facing the deflection point of the holding rope. The width of the groove is selected to be such that it is slightly smaller than the diameter of the holding rope led through the clamping mount. This special embodiment brings about an additional, third braking moment in the case of a pull on the securing rope. This arises from the fact that due to a strong pull of the securing rope, in addition to the clamping of the holding rope in the through hole between the housing and the clamping jaw and the subsequent bending of the entire safety device with the holding rope being guided over the above-described holding edge of the holding rope, the holding rope is additionally pressed on the upper side of the safety device facing the deflection point of the holding rope into the receiving groove extending there on the circumferential surface of the housing. The special size selected for the groove leads to an additional braking action.

Furthermore, it also proved to be advantageous that the support extending radially on the outside for the actuating rope is designed as a groove with an essentially semicircular cross section, wherein the position of the groove is preferably in the middle of the safety device to introduce the forces centrally. This design embodiment ensures that the safety rope is always held and guided in its correct position under all operating conditions, which is of crucial significance for the introduction of the braking forces.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
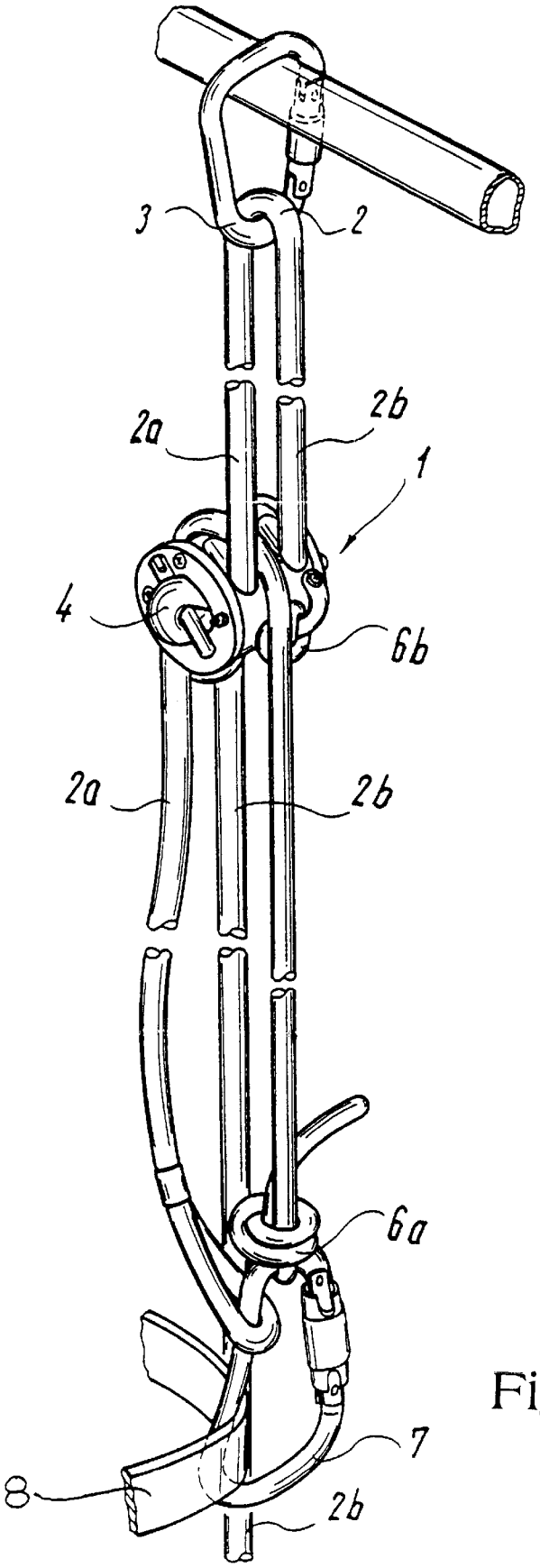
FIG. 1 is a perspective view of the safety device according to the present invention in the case of use according to the double-rope technique.

Referring to the drawings, FIG. 1 shows the safety device 1 according to the present invention in conjunction with a double-rope arrangement. The double-rope arrangement comprises a holding rope 2, which is led over a deflection point 3, which consists of a carabineer placed around a limb or the like in this exemplary embodiment. Both ends of the holding rope hanging down from the deflection point 3 run through the safety device 1. The end 2*a* is connected to the housing by a holding rope connection means, preferably by leading one part of the holding rope 2 over a toggle 5 of the safety device 1 and forming a loop 4 over the toggle 5. The free end 2*a* of the holding rope 2 is fixed in the safety device by this loop-toggle arrangement. The end 2*a*' leaving the safety device in the downward direction is fixed at its free end at a carabineer 7, which is in turn fastened to a waist belt 8 of a climber. The second free end 2*b* of the holding rope 2 likewise runs through the safety device 1 and hangs down under the safety device as a free end 2*b*'.

This free end 2*a* and 2*b*' is not fixed in the released position of the safety device 1 and is freely displaceable.

In addition, the free end 6*a* of a securing rope 6 is fastened at the lower carabineer 7 connected to the waist belt 8. This securing rope 6 leads from the carabineer 7 to the safety device 1, runs through between the free ends 2*a* and 2*b* of the holding rope 2, runs around the entire safety device and is fixed to same by means of a knot 6*b*.

Figure 2:
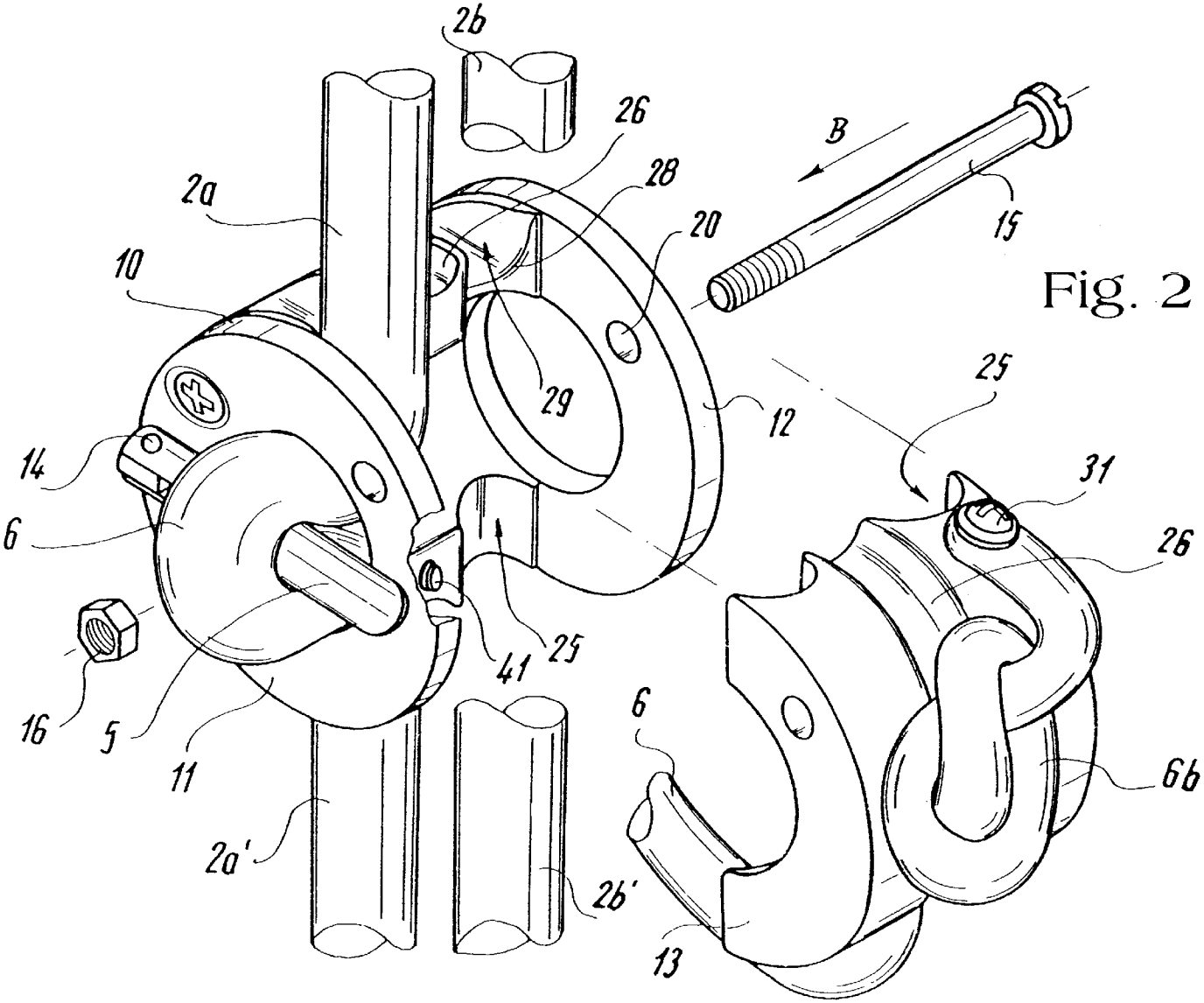
FIG. 2 is an exploded view of the safety device according to the present invention.

The design of the safety device 1 with the guiding of the free ends 2*a* and 2*b* of the holding rope 2 as well as of the securing rope 6 within and outside the safety device 1 can be specifically seen very clearly in the exploded view in FIG. 2. The safety device 1 comprises essentially a housing 10, which has two side cheeks 11 and 12, and a clamping jaw 13. The clamping jaw 13 is suspended in an articulated manner in the space formed by the side cheeks 11 and 12 by means of the screw-nut combination 15, 16. Through holes 20, 21, 22, through which the screw 15 extends, are provided for this purpose in both the side cheeks 11 and 12 and the clamping jaw 13. The free end 2*a* of the holding rope 2 enters the safety device 1 from the top, forms a loop 4 around the toggle 5 there, and then exits from the safety device in the downward direction as a free end 2*a*'. The toggle 5 is rotatably connected to the housing 10 by a hinge 14, so that separation of the holding rope 2 from the safety device 1 can be brought about when needed by enlarging the loop 4. A clamping support 25 for the free end 2*b*, 2*b*' of the holding rope 2 is located, in the form of a through hole, in parallel to the rope guide of the holding rope end 2*a*, 2*a*'.

Figure 5:
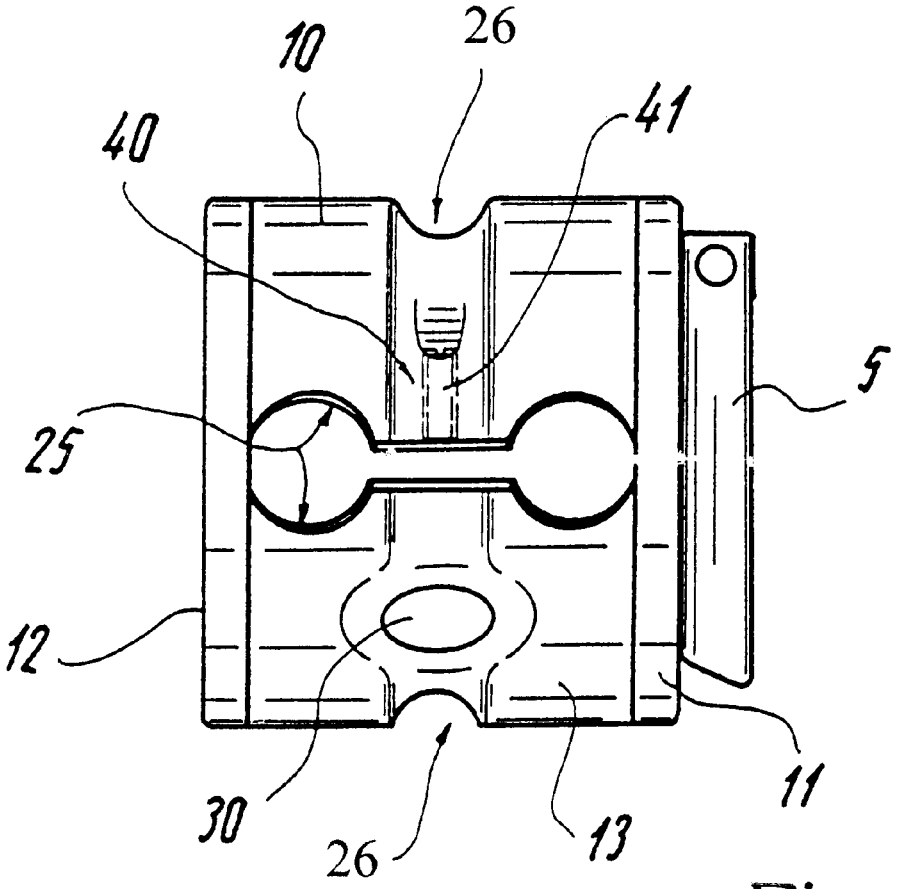
FIG. 5 is a view of the safety device according to the present invention corresponding to arrow D in FIG. 3.

In the assembled state, the safety device 1 forms a compact, space-saving assembly unit of an essentially cylindrical shape together with the housing 10 and the clamping jaw 13. A support 26, which has an essentially semicircular cross sectional groove, is arranged circularly and centrally on the outer contour of the housing 10 and of the clamping jaw 13. The securing rope 6 running around the entire safety device 1 is fixed to the movable clamping jaw 13. A radial hole 30 shown in FIG. 5, through which one free end of the securing rope 6 is pulled, is located for this purpose in the clamping jaw 13. The end 6*b* is knotted after exiting through the through hole 30 and is fastened to the clamping jaw 13 by means of a locking screw 31.

As is apparent from FIGS. 1 and 2, the securing rope 6 runs within the support 26 around the entire safety device and is then connected to the carabineer 7. If a pulling force is applied to the securing rope 6, the circular rope guide brings about a pressing together of the two components as a consequence of the articulated connection between the housing 10 and the clamping jaw 13. The end 2*b* of the holding rope 2 guided in the clamping support 25 is consequently clamped between the clamping jaw 13 and the housing 10.

A further pull on the securing rope 6 in the direction of the arrow P1 leads to a rotation of the entire safety device 1 in the direction of arrow P2 subsequent to the pressing together of the housing 10 and the clamping jaw 13.

Figure 3:
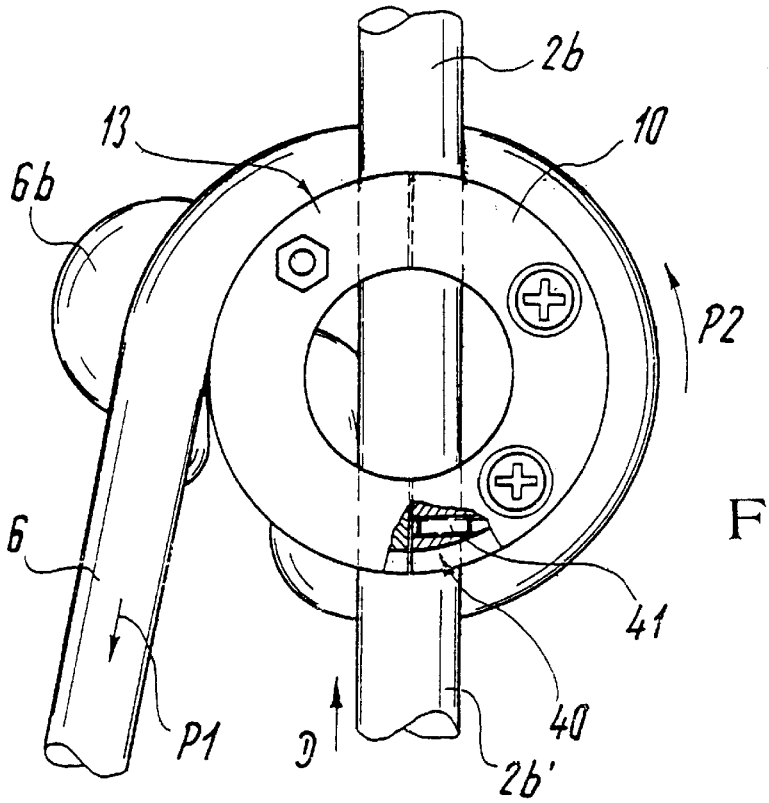
FIG. 3 is a side view corresponding to arrow B in FIG. 2 of the safety device according to the present invention in the released position for the holding rope.
Figure 4:
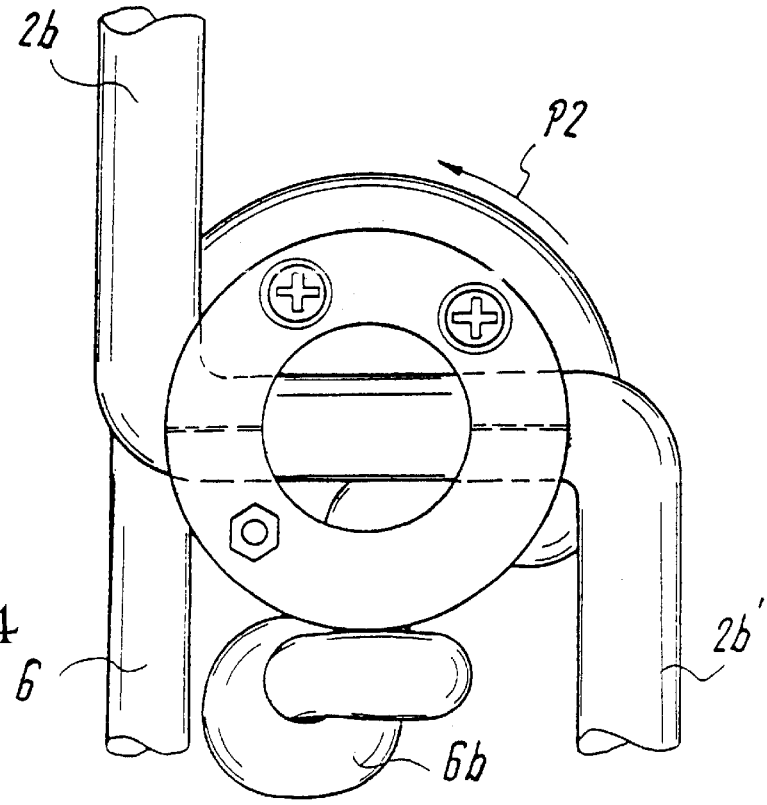
FIG. 4 is a view corresponding to FIG. 3 of the safety device in the clamped position.

The safety device is shown in FIG. 3 in the released position for the free end 2*b* of the holding rope 2. In contrast, FIG. 4 shows the position of the safety device 1 with the rope ends 2*b* and 2*b*' accommodated therein in the case of a pulling force acting in the direction of arrow P1 being applied correspondingly to the securing rope 6. It can be seen clearly that rotation of the entire safety device 1 by about 90° takes place in the direction of arrow P2 in the case of a corresponding pulling load on the securing rope 6.

As can be seen especially in FIG. 2, there is a groove friction means in the form of receiving groove 29 on the circumferential surface of the housing at the upper opening of the clamping mount facing the deflection point 3. The width of the receiving groove 29 is slightly smaller than the diameter of the holding rope 2. After rotation of the safety device as a consequence of the pulling forces acting on the securing rope, the rope end 2*b* comes to lie in the receiving groove 29 and is subjected to a further clamping action and, as a result, to an additional braking moment there due to the above-described dimensioning.

Due to the safety device rotating back, the clamping of the holding rope 2 in the receiving groove 29 is eliminated; the braking moment resulting from the pressing onto the holding edge 29 is eliminated at the same time, and the braking action acting on the holding rope 2 due to the pressing together of the clamping jaw 13 and the housing 10 is finally eliminated as well. The free rope end 2*b*, 2*b*' is thus freely displaceable through the safety device 1 and can be brought by the climbing person into any desired other position on the rope 2*b*, 2*b*'. The distance between the safety device 1 and the waist belt 8 is selected to be such that the climbing person can easily reach the safety device, It should be borne in mind in this connection that the length of the rope end 2*a*', which is also fastened to the carabineer 7, must be selected to be somewhat greater than the length of the securing rope 6 between the safety device and the fastening point 6*a* on the carabineer.

FIG. 3 additionally shows that the safety device 1 has an additional adjusting means 40, which permits the maximum clamping force for the holding rope 2 between the housing 10 and the clamping jaw 13 to be limited. The clamping device 40 comprises a clamping screw 41, which is received in a corresponding threaded hole of the housing 10. The front end of the clamping screw 41 is used as a stop buffer for the clamping jaw 13. The maximum pressing of the holding rope 2 can thus be set by screwing the spacing screw 41 in and out.

The total breaking force acting on the free end 2*b* of the holding rope 2 is distributed in the safety device according to the present invention between three different braking moments. On the one hand, the free rope end between the clamping jaw 13 and the housing 10 is clamped. Furthermore, an additional breaking moment is applied by an edge friction means which is formed by the bending of the safety device under a corresponding load on the securing rope, which results in a deflection of the holding rope and in a pressing on a holding edge 28. Finally, the pressing of the holding rope 2 into the receiving groove 29 forms a supplementary, third braking moment. Due to the individual braking moments occurring one after another, the fall of the roped-on person is correspondingly dampened during a fall, on the one hand, which can be additionally adjusted by the adjusting means or by the setting of the minimum distance between the clamping jaw 13 and the housing 10. This minimum distance can be set such that the clamping jaws will no longer clamp the rope running through between them under load under certain circumstances. Nevertheless, a braking power of about 80 kg is obtained due to the above-described supplementary braking moments. On the other hand, freely adjustable loosening of the safety device becomes possible even with one hand, because the corresponding braking moments are eliminated one after another. The possibility of a sensitive adjustment, in particular, enables the climber to slide down slowly on the holding rope, needing only one hand for operation; in addition, the body weight can be cushioned deliberately with the device according to the present invention when working in heights.

While specific embodiments of the invention have been shown and described in detail to illustrate the application of the principles of the invention, it will be understood that the invention may be embodied otherwise without departing from such principles.

APPENDIX

List of Reference Numbers

1 Safety device
2 Holding rope
3 Deflection point
4 Loop
5 Toggle
6 Securing rope

7 Carabineer
8 Waist belt
9 Housing
11 Side cheek
12 Side cheek
13 Clamping jaw
14 Hinge
15 Screw
16 Nut
20 Through hole
21 Through hole
22 Through hole
25 Clamping support
26 Support
28 Holding edge
29 Receiving groove
30 Through hole
31 Locking screw
40 Adjusting means
41 Spacing screw

What is claimed is:

1. A safety device for ascending and lowering processes for a person according to a double rope technique, the device comprising:

a holding rope:

a deflection point element, said rope passing over said deflection point element:

a housing, said holding rope having a first end and having an adjacent holding rope portion connectable to the person and firmly connected to said housing, said holding rope having a free second end;

a clamping jaw pivotally connected to said housing, said clamping jaw and housing cooperating to define a clamping support for clamping portion of said holding rope, between said first end and said second end, in a clamp position of said clamping jaw and for releasing said portion of the holding rope when said clamping jaw is in a release position to allow ascent and descent of the person, the deflection point element being positioned between said first end and said free second end of said holding rope, said housing and said clamping jaw cooperating to define a radially extending support on an outside of said housing and on an outside of said clamping jaw;

a securing rope connected to said clamping jaw and guided in said radially extending support extending radially around said clamping jaw and said housing, said securing rope acting on said radially extending support for actuating said clamping support by moving said clamping jaw from said release position to said clamping position when a load is placed on said securing rope.

2. A device in accordance with claim 1, wherein:

said clamping support includes an adjusting means for limiting a maximum clamping force for said holding rope between said housing and said clamping jaw.

3. A device in accordance with claim 2, wherein:

said adjusting means includes a spacing screw for setting a minimum distance between said housing and said clamping jaw.

4. A device in accordance with claim 3, wherein:

said spacing screw is arranged adjustably in a threaded hole of said housing.

5. A device in accordance with claim 1, wherein:

said clamping support defines a substantially cylindrical clamping through hole between said housing and said clamping jaw, said clamping through hole being substantially half defined by said housing and substantially half defined by said clamping jaw.

6. A device in accordance with claim 5, wherein:

said clamping through hole includes a holding edge on a side facing said deflection point element of said holding rope.

7. A device in accordance with claim 6, wherein:

said housing defines a receiving groove extending essentially at right angles to a central axis of said clamping through hole along a circumferential surface of said housing from an end of said clamping through hole facing said deflection point element, a width of said receiving groove being smaller than a diameter of said holding rope led through said clamping means.

8. A device in accordance with claim 5, wherein:

said housing defines a receiving groove extending essentially at right angles to a central axis of said clamping through hole along a circumferential surface of said housing from an end of said clamping through hole facing said deflection point element, a width of said receiving groove being smaller than a diameter of said holding rope led through said clamping means.

9. A device in accordance with claim 5, further comprising:

a holding edge of said clamping through hole, said load, on said securing rope rotating said housing and forcing the holding rope against said holding; edge to apply friction to said holding rope.

10. A device in accordance with claim 1, wherein:

said securing rope is firmly connected to said housing by a toggle lock.

11. A device in accordance with claim 1, wherein said housing has a groove with a width smaller than a diameter of the holding rope, said load on said securing rope rotating said housing and forcing the holding rope into said groove to apply friction to the holding rope.

12. A device in accordance with claim 1, wherein:

an object is connected to said securing rope to place said load on said securing rope; and said holding rope is connected to said object.

13. A device in accordance with claim 1, wherein:

said housing and said clamping jaw are connected by a hinge connection.

14. A device in accordance with claim 1, wherein:

said radially extending support for guiding said securing rope around said housing and said clamping jaw is a groove with a substantially semicircular cross section extending circularly and radially along the outside of said housing and said clamping jaw.

* * * * *